United States Patent [19]

Ikeda et al.

[11] 4,386,977

[45] Jun. 7, 1983

[54] WATER-IN-OIL EMULSION EXPLOSIVE

[75] Inventors: Yoshiyuki Ikeda; Atsuo Inoue; Yoshio Tanabe; Toshinori Ariki, all of Yamaguchi, Japan

[73] Assignee: Nippon Kayaku Kabushiki Kaisha, Tokyo, Japan

[21] Appl. No.: 239,410

[22] Filed: Mar. 2, 1981

[51] Int. Cl.[3] ..... C06B 45/00

[52] U.S. Cl. ..... 149/2; 149/21; 149/41; 149/47; 149/56; 149/57; 149/60; 149/70; 149/76; 149/85; 149/92

[58] Field of Search ..... 149/2, 21, 41, 47, 60, 149/56, 57, 70, 76, 85, 92

[56] References Cited

U.S. PATENT DOCUMENTS 4,218,272 8/1980 Brockington ..... 149/21

*Primary Examiner*—Stephen J. Lechert, Jr.

*Attorney, Agent, or Firm*—Henry C. Nields

[57] ABSTRACT

A water-in-oil emulsion explosive comprising 1 to 10% by weight of a continous phase of a petroleum wax having a melting point of 160° F. or more and containing 30% by weight or more of a urea-non-adduct component, 50 to 95% by weight of a discontinuous phase of an aqueous oxidizer solution containing ammonium nitrate as a major component, and 0.5 to 7% by weight of an emulsifier of an organic surface active agent wherein an unsaturated long-chain aliphatic acid constitutes a hydrophobic group.

3 Claims, No Drawings

WATER-IN-OIL EMULSION EXPLOSIVE

FIELD OF THE INVENTION

This invention relates to a water-in-oil emulsion explosive (hereinafter, referred to as "w/o emulsion explosive") having much higher stability than those of conventional w/o emulsion explosives. More particularly, it relates to a w/o emulsion explosive comprising 1 to 10% by weight of a continuous phase of a petroleum wax having a melting point of 160° F. or more and containing 30% by weight or more of a urea-non-adduct component, 50 to 95% by weight of a discontinuous phase of an aqueous solution of an oxidizer containing ammonium nitrate as a major component, and 0.5 to 7% by weight of an emulsifier selected from organic surface active agents containing an unsaturated long-chain aliphatic acid as a hydrophobic group. The present w/o emulsion explosive has markedly increased stability, which results from the use of a specific wax in combination with a specific surface active agent.

DESCRIPTION OF THE PRIOR ART

A w/o emulsion explosive was first disclosed in U.S. Pat. No. 3,161,551. Subsequent to this disclosure, modified w/o emulsion explosives were disclosed in U.S. Pat. Nos. 3,242,019; 3,447,978; 3,715,247; 3,770,522 and 4,008,108; and Japanese Patent Unexamined Publication No. 110308/1979.

The basic formulation of such w/o emulsion explosives comprises a continuous phase of a hydrophobic carbonaceous fuel, such as mineral oil and wax, a discontinuous phase of an aqueous solution of an oxidizing agent containing ammonium nitrate as a major component, and a w/o type emulsifier. By adding thereto suitable amounts of sensitizers such as nitric acid, strontium ion, hollow microspheres, etc., a wide range of sensitivity from Booster initiation to No. 6 cap initiation can be obtained.

It is well known in the art that these w/o emulsion explosives have excellent performance in respect of water resistance and safety which could not be expected from conventional explosives, because they use an oily substance as the continuous phase.

These w/o emulsion explosives, however, has the drawback that their stability is poor, because they are prepared by uniformly emulsifying two solutions mutually insoluble by the use of an emulsifier. That is, although w/o emulsion explosives produced by the prior art methods have desired sensitivity and performance just after the production thereof, the discontinuous phase dispersed coagulates with a lapse of time, finally resulting in the breakdown of the emulsion. Thus, these w/o emulsion explosives lose their initial sensitivity and performance in several months.

When the w/o emulsion explosive is produced and used by a so-called in-situ mixing method in which it is used in a very short time of period, for example, from several hours to several days after the production thereof, or by a method similar thereto, the problem of short storage stability as described above is not significant. In some cases, however, the w/o emulsion explosive is used in more one year, or in more than two years after the production thereof. In case that it is exported, it is used in two years or more after the production thereof.

In such cases, therefore, conventional w/o emulsion explosives are not suitable in view of their poor stability and storage life.

SUMMARY OF THE INVENTION

The object of this invention is to improve the stability and storage life of a w/o emulsion explosive and to provide a w/o emulsion explosive holding its excellent performance over a long period of time.

According to this invention, it has now been found that the storage stability of a w/o emulsion explosive can be greatly increased, for example, up to 3 years or more, by using a wax having a melting point of 160° F. or more and containing 30% by weight or more of a urea-non-adduct component as a continuous phase, and an organic surface active agent in which an unsaturated long-chain aliphatic acid constitutes the hydrophobic group, as an emulsifier.

This invention, therefore, provides a w/o emulsion explosive comprising 1 to 10% by weight of a continuous phase of a petroleum wax having a melting point of 160° F. or more and containing 30% by weight or more of a urea-non-adduct component, 50 to 95% by weight of a discontinuous phase of an aqueous solution of an oxidizer containing ammonium nitrate as a major component, and 0.5 to 7% by weight of an emulsifier selected from organic surface active agents containing an unsaturated long-chain aliphatic acid as the hydrophobic group.

DETAILED DESCRIPTION OF THE INVENTION

The fuel which is used as a continuous phase in this invention is a petroleum wax containing 30% by weight or more of a urea-non-adduct component. Petroleum wax usually contain n-paraffin, naphthene, iso-paraffin, and aromatic compounds. As an analytical method of determining the characteristics of such petroleum wax, there is a urea-adduction method which is described in detail in Tozo Amamiya, Edit., *Petrochemistry*, pages 534 to 548, Sangyo Tosho Co., Ltd. According to this method, petroleum wax is divided into a mixture of n-paraffin, a part of naphthene, a part of iso-paraffin, and a part of aromatic compounds (urea-adduct) and a mixture of a major portion of naphthenes, a major portion of iso-paraffins, and a major portion of aromatic compounds (urea-non-adduct) by utilizing urea.

As a result of extensive studies, it has been found that the stability of a w/o emulsion explosive can be markedly increased up to 3 years or more only in case that a petroleum wax containing 30% by weight or more of the urea-non-adduct component and having a melting point of 160° F. is used in combination with a specific surface active agent as hereinafter described.

Furthermore, it has been found that when a petroleum wax containing 30% by weight or more of the urea-non-adduct component and having a melting point of 160° F. or more is used, and a surface active agent as hereinafter described is used in as large an amount as 2.5 to 7% by weight, the storage stability of the resulting w/o emulsion explosive can further be increased to 4 years or more.

Table 1 below shows the melting point and the ratio of urea-non-adduct component to urea-adduct component (according to the urea adduction analytical method) of waxes available on the market.

TABLE 1

| No. | Trade Name | Distributor | M.P. | Urea-non-Adduct Component | Urea-Adduct Component |
|---|---|---|---|---|---|
| 1 | Paraffin Wax 135 | Mobil Oil Co., Ltd. | 135° F. | 0.9 | 99.1 |
| 2 | Mobil Wax 2305 | Mobil Oil Co., Ltd. | 181° F. | 67.5 | 32.5 |
| 3 | Mobil Wax Celease | Mobil Oil Co., Ltd. | 180° F. | 52.3 | 47.7 |
| 4 | Micro Wax 180 | Mobil Oil Co., Ltd. | 182° F. | 62.1 | 37.9 |
| 5 | Micro Wax 190Y | Mobil Oil Co., Ltd. | 194° F. | 46.7 | 53.3 |
| 6 | Waxrex 602 | Mobil Oil Co., Ltd. | 178° F. | 72.3 | 27.7 |
| 7 | Waxrex 140 | Mobil Oil Co., Ltd. | 151° F. | 21.5 | 78.5 |
| 8 | Waxrex 155 | Mobil Oil Co., Ltd. | 157° F. | 48.3 | 51.7 |
| 9 | 145° Paraffin | Nippon Oil Co., Ltd. | 146° F. | 1.8 | 98.2 |
| 10 | Nisseki Micro Wax 155 | Nippon Oil Co., Ltd. | 158° F. | 39.7 | 60.7 |
| 11 | Nisseki Micro Wax 180 | Nippon Oil Co., Ltd. | 184° F. | 50.7 | 49.3 |
| 12 | SP 3040 | Nippon Seiro Co., Ltd. | 145° F. | 2.9 | 97.1 |
| 13 | Hi-Mic 1045 | Nippon Seiro Co., Ltd. | 152° F. | 84.5 | 15.5 |
| 14 | Hi-Mic 1070 | Nippon Seiro Co., Ltd. | 172° F. | 66.5 | 33.5 |
| 15 | Hi-Mic 1080 | Nippon Seiro Co., Ltd. | 183° F. | 42.8 | 57.2 |
| 16 | Hi-Mic 2045 | Nippon Seiro Co., Ltd. | 131° F. | 78.5 | 21.5 |
| 17 | Hi-Mic 2065 | Nippon Seiro Co., Ltd. | 167° F. | 28.9 | 71.1 |
| 18 | Hi-Mic 2095 | Nippon Seiro Co., Ltd. | 205° F. | 35.4 | 64.6 |
| 19 | Hi-Mic 3080 | Nippon Seiro Co., Ltd. | 182° F. | 54.8 | 45.2 |
| 20 | Hi-Mic 3065 | Nippon Seiro Co., Ltd. | 167° F. | 61.2 | 38.8 |
| 21 | Hi-Mic 3045 | Nippon Seiro Co., Ltd. | 148° F. | 74.8 | 25.2 |
| 22 | Esmax 180 | Esso Standard Oil Co., Ltd. | 180° C. | 79.2 | 20.8 |
| 23 | Eslux 142 | Esso Standard Oil Co., Ltd. | 146° F. | 22.8 | 77.2 |
| 24 | Eslux 152 | Esso Standard Oil Co., Ltd. | 153° F. | 42.1 | 57.9 |
| 25 | Eslux 172 | Esso Standard Oil Co., Ltd. | 176° F. | 74.8 | 25.2 |

When of those petroleum waxes containing 30% by weight or more of the urea-non-adduct component, petroleum waxes having a melting point of 160° F. or more are used as the continuous phase in the range of from 1 to 10% by weight, preferably from 2 to 8% by weight, the storage stability of the resulting w/o emulsion explosive can be increased to 3 years or more.

In preparing the continuous phase of the present w/o emulsion explosive, the foregoing petroleum wax can be used in admixture with other waxes, such as animal wax and plant wax, paraffin waxes containing 30% by weight or less of the urea-non-adduct component, or the like. The amount of such other waxes being added, however, is limited to such a range that the ratio of the urea-non-adduct component to the mixture of the present petroleum wax and other waxes is not less than 30% by weight.

The aqueous oxidizer solution as herein used is composed principally of ammonium nitrate. Auxiliary oxidizers which can be used include alkali metal nitrates, such as sodium nitrate and potassium nitrate, alkaline earth metal nitrates, such as calcium nitrate and barium nitrate, alkali metal chlorates, such as sodium chlorate and potassium chlorate, alkaline earth metal chlorates, such as calcium chlorate and barious chlorate, alkali metal perchlorates, such as sodium perchlorate and potassium perchlorate, alkaline earth metal perchlorates, such as calcium perchlorate and barium perchlorate, and ammonium perchlorate. These auxiliary oxidizers can be used alone or in combination with each other.

To the aqueous oxidizer solution as herein used can be added, as an auxiliary sensitizer, water-soluble amine nitrates, such as monomethylamine nitrate, monoethylamine nitrate, hydrazine nitrate, and diethylamine dinitrate, water-soluble alkanolamine nitrates, such as methanolamine nitrate, and ethanolamine nitrate, and water-soluble ethylene glycol mononitrate.

The water content of the aqueous oxidizer solution is determined so that the crystal-precipitating temperature of the aqueous oxidizer solution is from 30° to 90° C. The water content is usually from 5 to 40% by weight and preferably from 7 to 30% by weight, based on the weight of the aqueous oxidizer solution. In order to lower the crystal-precipitating temperature, water-soluble organic solvents, such as methyl alcohol, ethyl alcohol, formamide, ethylene glycol, and glycerin, can be used as auxiliary solvents.

The aqueous oxidizer solution is within the range of from 50 to 95% by weight based on the total weight of the w/o emulsion explosive composition.

The emulsifier as used in this invention is an organic surface active agent wherein an unsaturated long-chain aliphatic acid containing 10 to 24 carbon atoms constitutes the hydrophobic group. Typical unsaturated long-chain aliphatic acids which can be used in this invention are shown below together with their molecular formula:

TABLE 2

| | |
|---|---|
| 1. Decenoic Acid | $C_9H_{17}COOH$ |
| 2. Undecylenic Acid | $C_{10}H_{19}COOH$ |
| 3. Laurolenic Acid | $C_{11}H_{21}COOH$ |
| 4. Myristolenic Acid | $C_{13}H_{25}COOH$ |
| 5. Pentadecenoic Acid | $C_{14}H_{27}COOH$ |
| 6. Somalinic Acid | $C_{15}H_{29}COOH$ |
| 7. Oleic Acid | $C_{17}H_{33}COOH$ |
| 8. Gadoleic Acid | $C_{19}H_{37}COOH$ |
| 9. Erucic Acid | $C_{21}H_{41}COOH$ |
| 10. Selacholeic Acid | $C_{23}H_{45}COOH$ |
| 11. Linoleic Acid | $C_{17}H_{31}COOH$ |
| 12. Linolenic Acid | $C_{17}H_{29}COOH$ |
| 13. Arachidonic Acid | $C_{20}H_{31}COOH$ |
| 14. Stearoleic Acid | $C_{17}H_{31}COOH$ |

In Table 2 above, Compound Nos. 1 to 10 are typical monosaturated aliphatic acids, Compound No. 11 is a typical diunsaturated apiphatic acid, Compound No. 12 is a typical triunsaturated aliphatic acid, Compound No. 13 is a typical tetraunsaturated aliphatic acid, and Compound No. 14 is a typical acetylenically unsaturated aliphatic acid.

Emulsifiers as used in this invention are sorbitan esters, glycerin esters, pentaerythritol esters, polyglycerin esters, polyoxyethylenesorbitan esters, polyethylene glycol esters, and alkanolamine reaction products of the foregoing unsaturated aliphatic acids, and mixtures thereof.

The amount of the emulsifier used is from 0.5 to 7% by weight.

When the petroleum wax containing 30% by weight or more of the urea-non-adduct and having a melting point of 160° F. or more is used in combination with a large amount as much as from 2.5 to 7% by weight of the foregoing emulsifier, a w/o emulsion explosive having further improved storage stability can be obtained; that is, the w/o emulsion explosive can maintain its initial performance over a long period of 4 years or more. In particular, when a petroleum wax containing 50% by weight or more of the urea-non-adduct and having a melting point or 170° F. or more is used, and sorbitan mono-oleate is used as the emulsifier in the amount of from 2.5 to 7% by weight, a w/o emulsion explosive having further improved storage stability can be obtained; that is, it has been confirmed that the initial performance of the w/o emulsion explosive does not change over a long period of 54 months or more.

By adding a suitable sensitizer to the w/o emulsion explosive of this invention, a wide range of sensitivity from cap Initiation to Booster initiation can be obtained. Sensitizers which can be used in this invention include non-explosive substances, such as hollow glass microspheres, hollow resin microspheres, silas balloon, and perlite, and explosive substances, such as TNT and pentolite.

Furthermore, by incorporating approximately air bubbles in place of hollow microspheres, the sensitization effect can be obtained.

The w/o emulsion explosive of this invention can further contain, as an auxiliary fuel, metal powder, such as aluminum powder and magnesium powder, and organic powders, such as wood powder and starch powder.

The following examples are given to illustrate this invention in greater detail.

EXAMPLE 1

Eslux 172 (2% by weight) selected from the petroleum waxes shown in Table 1 was heated to 80° C. and maintained at that temperature. To the thus-heated petroleum wax were added an aqueous oxidizer solution which had been prepared by mixing 16% by weight of water, 58% by weight of ammonium nitrate, and 13% by weight of sodium nitrate at 80° C., and an emulsifier of 5% by weight of sorbitan monooleate to obtain a w/o emulsion. To the thus-obtained w/o emulsion was added 6% by weight of perlite, and the resulting mixture was stirred to obtain a cap sensitive w/o emulsion explosive.

EXAMPLE 2

A mixture of 4% by weight of Waxrex 602 selected from the petroleum waxes shown in Table 1 and 1% by weight of 145° paraffin wax was heated to 80° C. and maintained at that temperature. To the thus-heated wax mixture were added an aqueous oxidizer solution which had been prepared by mixing 11% by weight of water, 65% by weight of ammonium nitrate, and 10% by weight of sodium chlorate at 80° C., and an emulsifier of a mixture of 2% by weight of sorbitan monooleate and 1% by weight of decenoic acid monoglyceride, to obtain a w/o emulsion. To the thus-obtained w/o emulsion were added 4% by weight of hollow glass microspheres (glass bubbles B 28/750, produced by 3M Company) and 2% by weight of aluminum powder, and the resulting mixture was stirred to obtain a cap sensitive w/o emulsion explosive.

EXAMPLE 3

The composition of this invention as shown in Table 3 was prepared in the same manner as in Example 2.

EXAMPLE 4

A mixture of 4% by weight of Nisseki Microwax 180 and 1% by weight of Waxrex 140 was heated to 70° C. and maintained at that temperature. To the thus-heated wax mixture were added an aqueous oxidizer solution which had been prepared by mixing 16% by weight of water, 52% by weight of ammonium nitrate and 17% by weight of ethanolamine nitrate at 70° C., and an emulsifier of 4% by weight of polyoxyethylene linolate to obtain a w/o emulsion. To the thus-obtained w/o emulsion was added 6% by weight of glass bubbles B 28/750 to obtain a cap sensitive w/o emulsion explosive.

EXAMPLE 5

A mixture of 2% by weight of Waxres 602 and 2% by weight of Esmax 180 was heated to 80° C. and maintained at that temperature. To the thus-heated wax mixture were added an aqueous oxidizer solution which had been prepared by mixing 22% by weight of water, 58% by weight of ammonium nitrate, 6% by weight of ammonium perchlorate, and 5% by weight of formamide at 80° C., and an emulsifier of 3% by weight of polyethylene glycol archidonic acid ester, to obtain a w/o emulsion. To the thus-obtained w/o emulsion was added 2% by weight of hollow glass micropheres B 28/750, and the resulting mixture was stirred to obtain a Booster initiation w/o emulsion explosive.

EXAMPLES 6 and 7

The compositions of this invention as shown in Table 3 were prepared in the same manner as in Example 5.

EXAMPLE 8

The composition of this invention as shown in Table 3 was prepared in the same manner as in Example 2.

The composition of Examples 1 to 8 were tabulated in Table 3.

TABLE 3

| | Example No. | | | | | | | |
|---|---|---|---|---|---|---|---|---|
| | 1 | 2 | 3 | 4 | 5 | 6 | 7 | 8 |
| Eslux 172 | 2 | | | | | | | 2 |
| Nisseki Microwax 180 | | | 5 | 4 | | | 5 | |
| Waxrex 602 | | 4 | | | 2 | 5 | | |
| Esmax 180 | | | | | 2 | | | |
| 145° Paraffin (Nippon Oil) | | 1 | | | | | | |
| Waxrex 140 | | | 2 | 1 | | | | |
| Water | 16 | 11 | 20 | 16 | 22 | 14 | 18 | 16 |
| Ammonium Nitrate | 58 | 64 | 45 | 52 | 58 | 61 | 61 | 61.5 |
| Sodium Nitrate | 13 | | | | | 10 | | 13 |
| Calcium Nitrate | | | 5 | | | | | |
| Sodium Chlorate | | 10 | | | | | | |

TABLE 3-continued

| | Example No. | | | | | | | |
|---|---|---|---|---|---|---|---|---|
| | 1 | 2 | 3 | 4 | 5 | 6 | 7 | 8 |
| Barium Perchlorate | | | 7 | | | | | |
| Ammonium Perchlorate | | | | | 6 | | | |
| Monomethylamine Nitrate | | | | | | | 10 | |
| Ethanolamine Nitrate | | | | 17 | | | | |
| Formamide | | | | | 5 | | | |
| Sorbitan Monooleate | 5 | 2 | | | | 3.5 | 1 | 1.5 |
| Decenoic Acid Monogylceride | | 1 | | | | | | |
| Pentaerythritol Selacholeic Acid Ester | | | 1 | | | | | |
| Polyoxyethylene Linolate | | | | 4 | | | | |
| Polyethyleneglycol Archidonic Acid Ester | | | | | 3 | | | |
| Stearolic Acid Alkanolamine Reaction Product | | | | | | | 2.5 | |
| Glass Bubbles B 28/750 | | 4 | 5 | 6 | 2 | 6.5 | 1.5 | |
| Perlite | 6 | | | | | | 1.0 | 6 |
| T N T | | | 10 | | | | | |
| Aluminum Powder | | 2.0 | | | | | | |

COMPARATIVE EXAMPLE 1

Using a petroleum wax whose urea-non-adduct component content was not within the range of this invention, the composition as shown in Table 4 was prepared in the same manner as in Example 2.

COMPARATIVE EXAMPLE 2

Using a petroleum wax mixture whose urea-non-adduct component content was not within the range of this invention, the composition as shown in Table 4 was prepared in the same manner as in Example 2.

COMPARATIVE EXAMPLE 3

Using an emulsifier wherein a saturated aliphatic acid constituted the hydrophobic group, the composition as shown in Table 4 was prepared in the same manner as in Example 4.

COMPARATIVE EXAMPLES 4 and 5

The typical compositions which have heretofore been in practical use, as shown in Table 4 were prepared in the same manner as in Example 1.

The compositions of Comparative Examples 1 to 5 were tabulated in Table 4.

For the compositions of Examples 1 to 8 and Comparative Examples 1 to 5, detonation velocity and minimum booster amount were measured over 2 years in order to determine the performance and the storage stability, respectively. Furthermore, a heat-acceleration testing method which was practically used in the field of emulsions was carried out to obtain the correlation between the heat acceleration testing method and the foregoing room temperature storage stability testing method. By using the correlation, the value corresponding to 4.5 years was determined. The results are shown in Table 5.

TABLE 4

| | Comparative Example | | | | |
|---|---|---|---|---|---|
| | 1 | 2 | 3 | 4 | 5 |
| Paraffin Wax 135 (Mobil Oil) | 5 | 5 | | | |
| Eslux 142 | | | | | 5 |
| Hi-Mic 2065 | | | | 8 | |
| Nisseki Micro 180 | | 2 | 5 | | |
| Water | 11 | 20 | 15 | 15 | 18 |
| Ammonium Nitrate | 65 | 45 | 55 | 69 | 61 |
| Sodium Nitrate | | 5 | 15 | | 12.5 |
| Sodium Chlorate | 10 | | | | |
| Sodium Perchlorate | | 7 | | | |
| Sorbitan Tristearate | | | 3 | | |
| Polyoxyethylene Stearate | | | | 2 | |
| Pentaerythritol Laurate | | | | | 1 |
| Sorbitan Monooleate | 3 | 1 | | | |
| Glass Bubbles B 28/750 | 4 | 5 | | 6 | 1.5 |
| Perlite | | | 7 | | 1 |
| T N T | | 10 | | | |
| Aluminum Powder | 2 | | | | |

TABLE 5

| | | Example | | | | | | | | Comparative Example | | | | |
|---|---|---|---|---|---|---|---|---|---|---|---|---|---|---|
| | | 1 | 2 | 3 | 4 | 5 | 6 | 7 | 8 | 1 | 3 | 3 | 4 | 5 |
| Specific Density | | 1.10 | 1.12 | 1.08 | 1.01 | 1.20 | 1.10 | 1.22 | 1.08 | 1.11 | 1.09 | 1.09 | 1.03 | 1.22 |
| Just after | Detonation Velocity*1 | 4620 | 4580 | 4710 | 4710 | 4820 | 4720 | 4780 | 4600 | 4630 | 4710 | 4630 | 4580 | 4800 |
| Production | Minimum Booster Amount | No.6*2 | No.6 | No.6 | No.6 | P10g*4 | No.6 | P15g | No.6 | No.6 | No.6 | No.6 | No.6 | P15g |
| After | Detonation Velocity | 4630 | 4590 | 4690 | 4690 | 4890 | 4800 | 4620 | 4650 | 4590 | 4410 | 4610 | 4490 | 4350 |
| 2 months | Minimum Booster Amount | No.6 | No.6 | No.6 | No.6 | P10g | No.6 | P15g | No.6 | No.6 | No.8 | No.6 | No.8 | P50g |
| After | Detonation Velocity | 4590 | 4620 | 4660 | 4670 | 4780 | 4690 | 4680 | 4590 | 4620 | 4370 | 4580 | 4410 | ⊙ |
| 4 months | Minimum Booster Amount | No.6 | No.6 | No.6 | No.6 | P10g | No.6 | P15g | No.6 | No.6 | P10g | No.6 | P10g | |
| After | Detonation Velocity | 4610 | 4560 | 4730 | 4680 | 4820 | 4710 | 4770 | 4610 | 4640 | 4210 | 4670 | 4250 | — |
| 6 months | Minimum Booster Amount | No.6 | No.6 | No.6 | No.6 | P10g | No.6 | P15g | No.6 | No.6 | P50g | No.6 | P50g | — |
| After | Detonation Velocity | 4700 | 4610 | 4650 | 4690 | 4670 | 4750 | 4720 | 4630 | 4510 | ⊙ | 4410 | ⊙ | — |
| 12 months | Minimum Booster Amount | No.6 | No.6 | No.6 | No.6 | P10g | No.6 | P15g | No.6 | P5g | | P10g | | — |
| After | Detonation Velocity | 4650 | 4550 | 4710 | 4610 | 4740 | 4680 | 4630 | 4600 | 4160 | — | 4120 | — | — |
| 24 months | Minimum Booster Amount | No.6 | No.6 | No.6 | No.6 | P10g | No.6 | P15g | No.6 | 100g | — | 100g | — | — |
| After | Detonation Velocity | 4630 | 4420 | 4720 | 4650 | 4840 | 4850 | 4750 | 4620 | ⊙ | — | ⊙ | — | — |
| 30 months*5 | Minimum Booster Amount | No.6 | No.6 | No.6 | No.6 | P10g | No. 6 | P15g | No.6 | | — | | — | — |
| After | Detonation Velocity | 4610 | 4560 | 4700 | 4700 | 4690 | 4770 | 4760 | 4530 | — | — | — | — | — |
| 36 months | Minimum Booster Amount | No.6 | No.6 | No.6 | No.6 | P10g | No.6 | P15g | No.8 | — | — | — | — | — |
| After | Detonation Velocity | 4710 | 4610 | 4730 | 4600 | 4810 | 4790 | 4720 | ⊙ | — | — | — | — | — |
| 42 months | Minimum Booster Amount | No.6 | No.6 | No.6 | No.6 | P10g | No.6 | P15g | | — | — | — | — | — |
| After | Detonation Velocity | 4690 | 4540 | 4580 | 4630 | 4770 | 4720 | 4730 | — | — | — | — | — | — |
| 48 months | Minimum Booster Amount | No.6 | No.6 | No.8 | No.6 | P10g | No.6 | P15g | — | — | — | — | — | — |
| After | Detonation Velocity | 4710 | 4500 | ⊙ | 4720 | 4710 | 4730 | 4800 | — | — | — | — | — | — |

TABLE 5-continued

| | | Example | | | | | | | | Comparative Example | | | | |
|---|---|---|---|---|---|---|---|---|---|---|---|---|---|---|
| | | 1 | 2 | 3 | 4 | 5 | 6 | 7 | 8 | 1 | 3 | 3 | 4 | 5 |
| 54 months | Minimum Booster Amount | No.6 | No.8*3 | | No.6 | P20g | No.6 | P15g | — | — | — | — | — | — |

Note:
⊙: not measured
*1Measured in a JIS iron tube according to the Doutriche testing method (m/sec).
*2No.6 indicates an industrial No.6 cap.
*3No.8 indicates an industrial No.8 cap.
*4P indicates 50:50 Pentolite.
*5The data after 30 months were obtained by calculating based on the correlation between the heat acceleration testing method and the ordinary temperature storage test.

As apparent from the results shown in Table 5, in Comparative Examples in which conventional compositions are used, the sensitivity and performance lower in less than 1 year, whereas in Examples in which the compositions of this invention are used, the sensitivity and performance are maintained for more than 3 years or, depending on the case, for more than 4 years. This indicates that the w/o emulsion explosive of this invention is markedly improved in its stability.

We claim:

1. A water-in-oil emulsion explosive comprising 1 to 10% by weight of a continuous phase of a petroleum wax having a melting point of 160° F. or more and containing 30% by weight or more of a urea-non-adduct component, 50 to 95% by weight of a discontinuous phase of an aqueous oxidizer solution containing ammonium nitrate as a major component, and 0.5 to 7% by weight of an emulsifier selected from organic surface active agents containing an unsaturated long-chain aliphatic acid as a hydrophobic group.

2. The water-in-oil emulsion explosive as claimed in claim 1 wherein the emulsifier content is from 2.5 to 7% by weight.

3. The water-in-oil emulsion explosive as claimed in claim 1 wherein the petroleum wax as a melting point of 170° F. or more and contains 50% by weight or more of the urea-non-adduct component, and the emulsifier is sorbitan mono-oleate, which constitutes from 2.5 to 7% by weight of the emulsion explosive.

* * * * *

UNITED STATES PATENT AND TRADEMARK OFFICE

CERTIFICATE OF CORRECTION

PATENT NO. : 4,386,977

DATED : June 7, 1983

INVENTOR(S) : Yoshiyuki Ikeda, et al.

It is certified that error appears in the above-identified patent and that said Letters Patent is hereby corrected as shown below:

On the Title Page, the following item [30] should be inserted between item [22] and item [51]:

—[30] Foreign Application Priority Data

March 12, 1980 [JP] Japan .....55-30268—

Signed and Sealed this

*Fourteenth* Day of *August 1984*

[SEAL]

*Attest:*

GERALD J. MOSSINGHOFF

*Attesting Officer*

*Commissioner of Patents and Trademarks*